US008671498B2

(12) United States Patent
Ferlito et al.

(10) Patent No.: US 8,671,498 B2
(45) Date of Patent: Mar. 18, 2014

(54) CLEANING DEVICE

(76) Inventors: Frank J. Ferlito, Fort Myers, FL (US); Frank Ferlito, II, Saint Clair, MI (US)

( * ) Notice: Subject to any disclaimer, the term of this patent is extended or adjusted under 35 U.S.C. 154(b) by 411 days.

(21) Appl. No.: 13/050,296

(22) Filed: Mar. 17, 2011

(65) Prior Publication Data

US 2012/0233797 A1 Sep. 20, 2012

(51) Int. Cl.
*A47L 13/06* (2006.01)

(52) U.S. Cl.
USPC ..... 15/145; 15/176.1; 15/236.06; 15/236.01

(58) Field of Classification Search
USPC ..... 15/143.1, 145, 146, 147.1, 176.1, 15/176.6, 244.1, 236.01, 236.07–236.09, 15/160, 210.1
See application file for complete search history.

(56) References Cited

U.S. PATENT DOCUMENTS

| | | | | | |
|---|---|---|---|---|---|
| D96,630 | S | | 8/1935 | Smith | |
| 3,991,431 | A | * | 11/1976 | Thielen | 15/147.2 |
| 4,229,032 | A | | 10/1980 | Murphy | |
| 4,255,827 | A | | 3/1981 | Palazzo | |
| 4,509,224 | A | * | 4/1985 | Batchelor | 15/244.1 |
| 5,312,197 | A | | 5/1994 | Abramson | |
| 6,591,442 | B2 | * | 7/2003 | Kaminstein | 15/228 |
| 6,658,688 | B2 | | 12/2003 | Gavney, Jr. | |
| 6,772,466 | B2 | | 8/2004 | Ziegler | |
| 6,820,300 | B2 | | 11/2004 | Gavney, Jr. | |
| D506,587 | S | | 6/2005 | Armaly, Jr. | |
| 7,069,616 | B2 | | 7/2006 | Watkins | |
| 7,168,124 | B2 | | 1/2007 | Dalias | |
| 7,210,188 | B1 | | 5/2007 | Kirby | |
| 7,363,678 | B2 | * | 4/2008 | Varner | 15/245 |
| D576,366 | S | | 9/2008 | Kubes et al. | |
| D578,718 | S | | 10/2008 | Bettanin | |
| 7,454,813 | B2 | | 11/2008 | Kaltenegger | |
| D602,665 | S | | 10/2009 | Porcini et al. | |
| D610,321 | S | | 2/2010 | Leahy et al. | |
| 2003/0074754 | A1 | | 4/2003 | Holden | |
| 2005/0086754 | A1 | | 4/2005 | Dalias | |
| 2007/0101529 | A1 | | 5/2007 | Garcia | |
| 2009/0301520 | A1 | | 12/2009 | Schaaf | |

FOREIGN PATENT DOCUMENTS

| | | |
|---|---|---|
| DE | 33 22 355 A1 | 1/1985 |

* cited by examiner

*Primary Examiner* — Laura C Guidotti
(74) *Attorney, Agent, or Firm* — Harness, Dickey & Pierce, P.L.C.

(57) ABSTRACT

A cleaning device has a handle removably connected to a cleaning head. The handle includes a connecting mechanism to removably couple the handle with the cleaning head. The cleaning head includes a projecting member to mate with an arcuate surface of the handle to enable rotation to removably connect the cleaning head with the handle. The cleaning head has an overall corrugated appearance.

16 Claims, 3 Drawing Sheets

CLEANING DEVICE

FIELD

The present disclosure relates to cleaning devices and, more particularly, to devices used to clean corrugated doors.

BACKGROUND

With the ever increasing need for more storage space, a number of storage facilities have sprouted up throughout the United States. Ordinarily, the storage facilities include a plurality of different sized areas in a single building. The areas generally have an opening that is closed off by a movable door. Generally, the movable doors are of the roll-up type. These doors, for strength purposes, generally have a pleasing corrugated appearance. Thus, the doors include a plurality of truncated peaks and valleys that form the outer appearance of the door. These corrugated doors perform satisfactorily for their intended purpose.

In order to maintain the storage facility, it is desirable to keep the storage facility clean. To clean the facility, the buildings and doors may be washed down or hosed off from time to time via a high pressure spray washer. Additionally, sometimes it is desirable to remove dust or debris from the door. However, due to the corrugation of the door, it is difficult to remove the water, debris, residue or the like from the door. While ordinary brushes, sponges or the like have been used, they do not conform well to the corrugation to enable smooth cleaning of the doors. Thus, it would be desirable to have a cleaning device that enables rapid and adequate removal of water, debris, residue or the like from the door.

SUMMARY

According to the present disclosure, a cleaning device is provided that easily removes debris, water, residue or the like from a corrugated door. The present disclosure provides a device that enables easy manual manipulation. The present device provides a cleaning device with a readily removable cleaning element. The cleaning element is conformed to the corrugated surface to rapidly clean the corrugated surface. The cleaning device provides multiple cleaning heads to provide the best solution for cleaning a corrugated door.

According to a first aspect of the disclosure, a cleaning device comprises a handle including a first and second portion. The first portion includes a mechanism to enable manipulation of the handle. The second portion includes a positioning mechanism and a connecting mechanism. The cleaning head is coupled with the handle. The cleaning head includes a base to connect with the second portion connecting mechanism. The cleaning member is coupled with the base. The cleaning member provides a corrugated appearance. The second portion connecting mechanism further comprises a recess at a first end of the second portion to receive a portion of the base. A boss is at the second end of the second portion and includes a mechanism to receive a fastener. The boss includes a cutout to frictionally hold a nut. The base includes spaced projections to provide rigidity for the corrugation. The base includes a plurality of ribs mating with the second portion positioning members. The base includes a projection at one end to mate with the recess. A bore is formed in the base to receive the boss.

According to a second aspect of the disclosure, a cleaning device comprises a handle removably connected to a cleaning head. The handle includes an upper portion and a lower portion. The upper portion includes a member to enable manipulation of the cleaning device. The lower portion includes a connecting mechanism to removably couple the handle with the cleaning head. The connecting mechanism includes a projection at one end of the lower portion. The connecting mechanism includes a channel defining an arcuate surface. The boss is at the other end of the lower portion. The boss includes a mechanism to receive a fastener. The cleaning head includes a base with one end including a projection with an arcuate surface to mate with the arcuate surface of the channel of the lower portion. The cleaning head includes an aperture to receive the boss. A fastener extends through the base to removably secure the cleaning head with the handle. The base includes a plurality of stiffening ribs. The base includes a plurality of peaks and valleys. The cleaning member is secured with the base peaks and valleys to provide a corrugated design. The peaks are truncated and have an overall trapezoidal shape when viewed in side elevation. The valleys are defined by adjacent sides of the truncated peaks with an included angle between the truncated peaks of about 55°-90°. The lower portion includes a plurality of positioning members. The upper portion includes an aperture providing an opening for a user's handle to enable manual manipulation of the handle. The cleaning member is comprised of sponge, brush, felt, fabric, or abrasive material of the like or a combination thereof.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
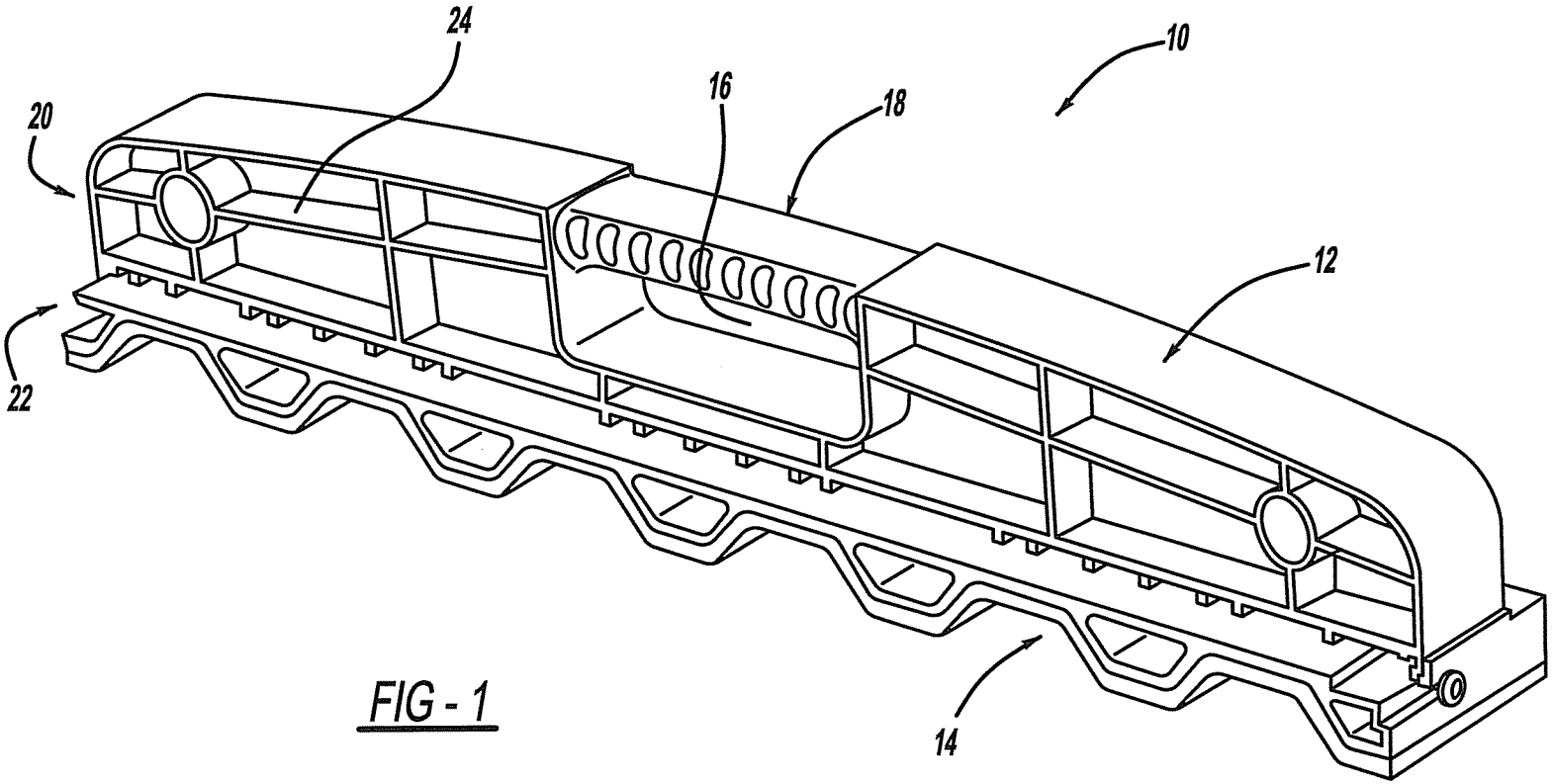
FIG. 1 is a perspective view of the cleaning device.

Turning to the figures, a cleaning device is illustrated and designated with the reference numeral 10. The cleaning device 10 includes a handle 12 and a cleaning head 14. The handle 12 may be manufactured by an injection molded process from a desired plastic material. The handle 12 includes an aperture 16 that defines a rail gripping portion 18. The aperture 16 enables passage of a user's hand through it to grip the rail portion 18 to enable manual manipulation of the handle 12.

The handle 12 has a first or upper portion 20 and a second or lower portion 22. The upper portion 20 includes the aperture 16 and rail 18. Additionally, it includes a plurality of stiffening ribs 24 to provide rigidity to the handle 12. The upper portion 20 may have any desired shape and is shown with an overall rectangular configuration with a bulging middle and curved ends.

The second or lower portion 24 includes a plate 26 that includes a positioning mechanism 28 and a connecting mechanism 30. The plate 26 has an overall rectangular shape with the positioning mechanism 28 including a plurality of projections 32 spaced along the longitudinal edges 33, 35 of the plate 26. The positioning projections 32 receive portions of the cleaning head 14 to retain the cleaning head 14 in position as will be discussed later.

The connecting mechanism 30 includes a recess portion 34 at one lateral end 37 of the plate 26 and a boss 36 at the other lateral end 39 of the plate 26. The recess portion 34 is formed in an L-shaped projection 38. The recess 34 includes an arcuate surface 40 to receive a portion of a cleaning head 14 as will be described later. The boss 36 projects from the plate 26. The boss 36 includes a channel 42 to receive and secure a nut 44 in the channel 42. An aperture 46 passes through the boss 36 to enable passage of a fastener into the nut 44.

Figure 2:
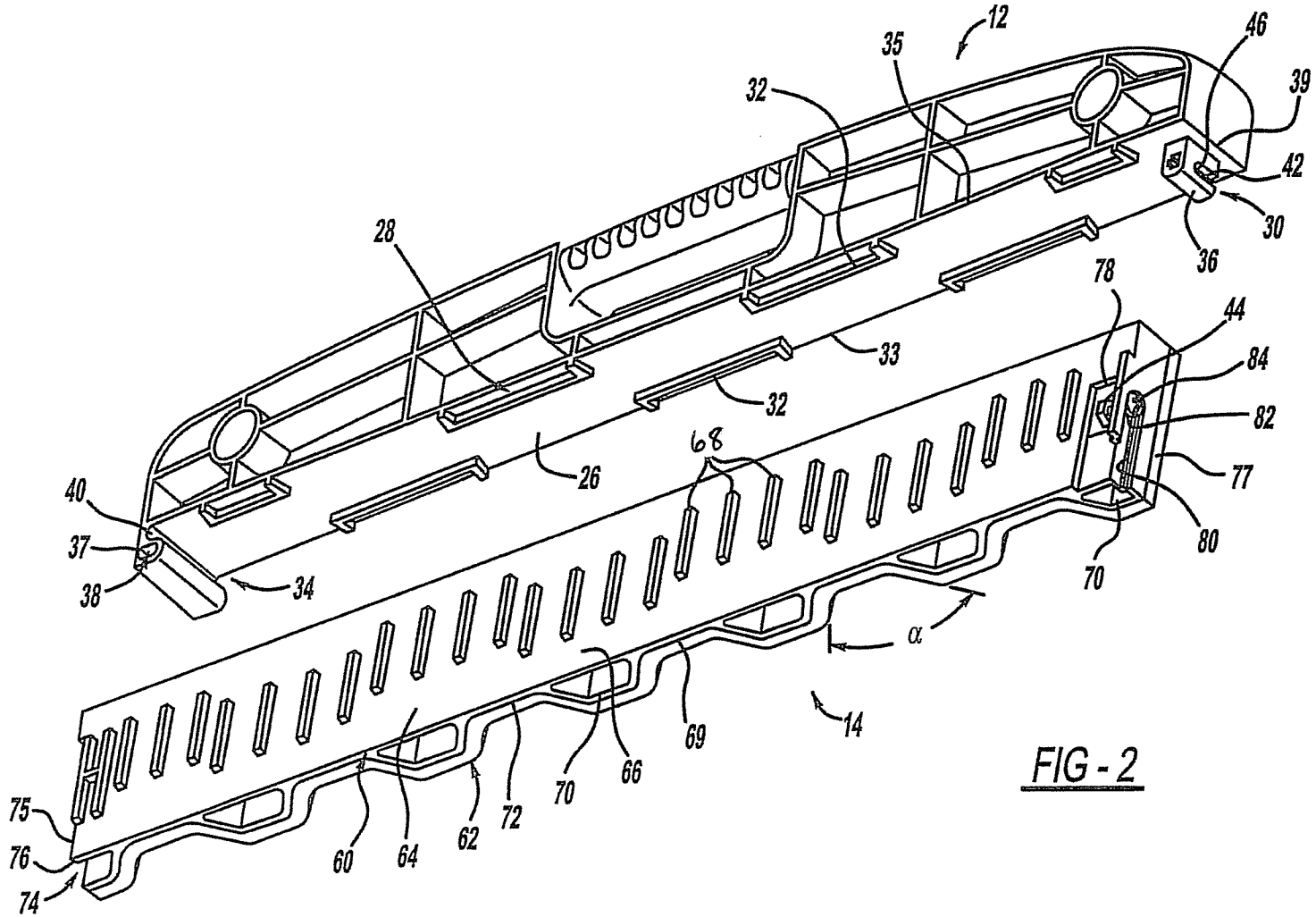
FIG. 2 is an exploded view of the cleaning device of FIG. 1.
Figure 3:
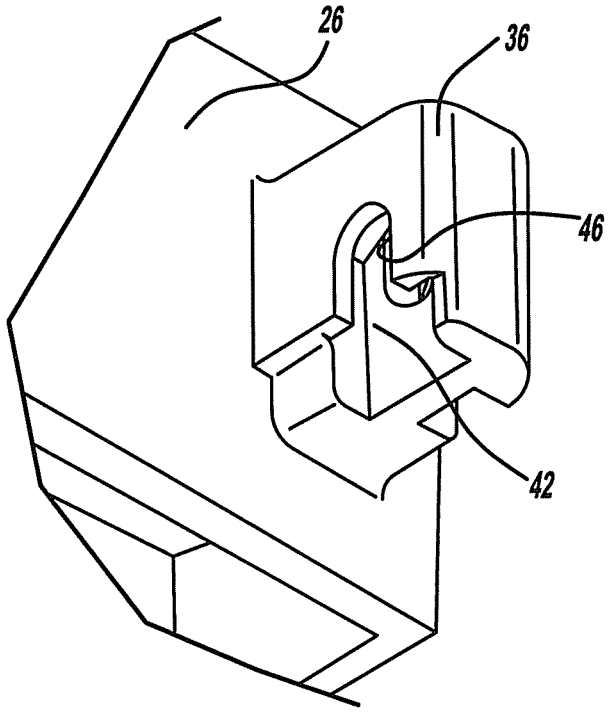
FIG. 3 is an enlarged partial view of a first end of the cleaning device.
Figure 4:
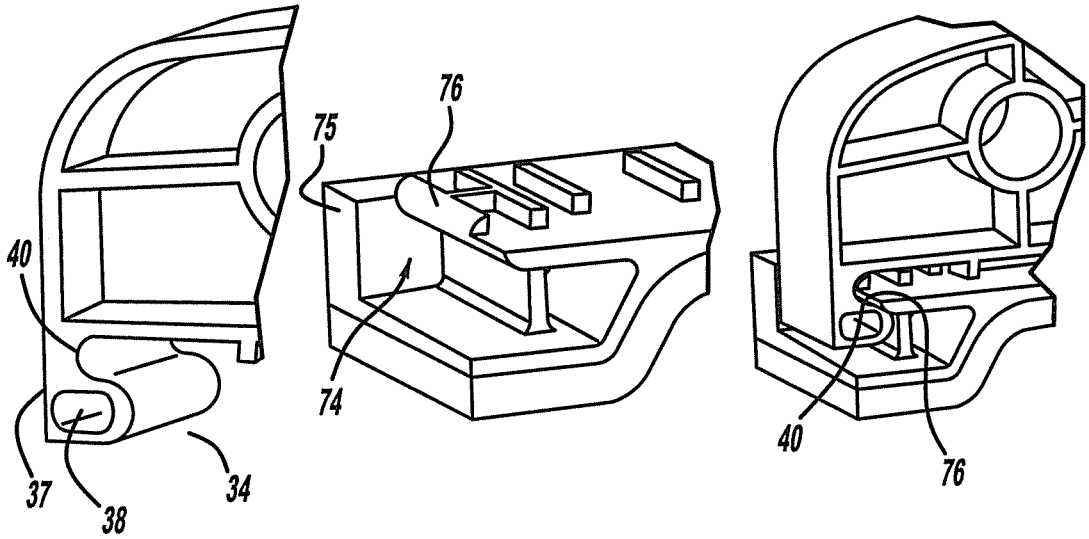
FIG. 4 is an enlarged partial view of the second end of the cleaning device.

The cleaning head 14 includes a base 60 and a cleaning member 62. The base 60 has an overall rectangular shape with a plate 64 having first 66 and second 69 sides. The first side 66 includes a plurality of stiffening positioning ribs 68. The positioning ribs 68 follow a desired pattern on the first side 66 as seen in FIG. 2. The ribs 68 are positioned between the positioning projections 32 of the second portion 22 of the handle 12 to maintain the base 60 in position on the handle 12. The second side 65 of the base 60 includes a plurality of truncated peaks 70 and valleys 72. The truncated peaks 70 have an overall trapezoidal shape when viewed in side elevation. The valleys 72 define a recess between the adjacent truncated peaks 70. The recesses 72 include an included angle between sides of the adjacent truncated peaks 70 to have an included angle $\alpha$ from about 55° to 90°. Preferably, the angle is between about 60° to 80°.

One end 75 of the plate 64 defines a projection member 74. The projection member 74 includes an arcuate surface 76. The arcuate surface 76 mates with the arcuate surface of the lower portion 22 of the handle 12 to provide rotatable sliding movement of the base 60 on the handle 12. This enables easy removable of the base 60 from the handle 12. The other end 77 of the base 60 includes an aperture 78 extending it to a hollow truncated peak 70. The aperture 78 enables the boss 36 to enter into the hollow truncated trapezoidal shape peak 70. A slot 80 and an aperture 82 are formed on the end 77 of the base 60. The slot 80 provides a recess for a fastener head 84. The aperture 82 enables the fastener 84 to pass through the base 60 to secure with the nut 44 secured in the boss 36. Thus, one end 75 of the base 60 is positioned into the recess 34 of the handle portion 12. The cleaning head 14 is rotated upward to enable the boss 36 to project through the aperture 78. As this occurs, the fastener 84 is secured with the nut 44 to removably secure the cleaning head 14 with the handle 12.

The cleaning member 62 can be formed from any desired materials, such as a sponge (natural or synthetic), foam, brush material, felt, fabric material, abrasive material or a combination of the like may be utilized as the cleaning material 62. The cleaning member 62 can be secured to the truncated peaks 70 and valleys 72 by conventional means such as adhesives or the like. Further, a hook and lube type fastener could be positioned on the peaks 70 and valleys 72 as well as on the clearance member 62 to retain a cleaning member 62 onto the base 60. The cleaning member 62 follows the contour of the truncated peaks 70 and valleys 72 to provide a corrugated appearance for the cleaning head 14. Thus, the recess included angle between adjacent truncated peaks 70 provides an area that corresponds to peaks and valleys of commonly utilized corrugated doors of a storage facility. Additionally, various types of cleaning heads can be removably secured with the handle to provide the desired optimum cleaning material for a desired purpose.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cleaning device comprising:

a handle, the handle having a first portion and a second portion, the first portion including a mechanism for enabling manipulation of the handle, the second portion including a positioning mechanism and a connecting mechanism, the second portion connecting mechanism further comprises a recess at a first end of the second portion to receive a portion of the base and a boss at a second end of the second portion, the boss including a mechanism to receive a fastener;

a cleaning head coupled with the handle, the cleaning head including a base for positioning onto and connecting with the second portion, and a cleaning member coupled with the base, the cleaning head providing a cleaning surface with a corrugated appearance.

2. The cleaning device of claim 1, wherein the boss includes a cut-out to frictionally hold a nut.

3. The cleaning device of claim 1, wherein the base includes a projection at one end mating with the recess.

4. The cleaning device of claim 1, wherein the base has a bore to receive the boss.

5. The cleaning device of claim 1, wherein the base further comprises spaced ribs to provide rigidity and enable positioning of the base on the handle.

6. The cleaning device of claim 1, wherein the base includes a plurality of ribs cooperating with second portion positioning members.

7. A cleaning device comprising:

a handle removably connected to a cleaning head;

the handle including a upper portion and a lower portion, the upper portion includes a member for enabling manipulation of the cleaning device, the lower portion includes a connecting mechanism removably coupling the handle with the cleaning head, the connecting mechanism includes a projection at one end of the lower portion, the projection includes a channel defining an arcuate surface and a boss at another end of the lower portion, the boss includes a mechanism to receive a fastener, the cleaning head includes a base, the base has an end including a projection with an arcuate surface, the projection mates with the arcuate surface of the channel, the base also including an aperture at its other end, the aperture receives the boss, a fastener extends through the base into the boss to removably secure the cleaning head with the handle.

8. The cleaning device of claim 7, wherein the base includes a plurality of stiffening ribs.

9. The cleaning device of claim 7, wherein the base includes a plurality of peaks and valleys.

10. The cleaning device of claim 9, wherein the cleaning head further comprises a cleaning member secured with the base peaks and valleys providing a corrugated appearance.

11. The cleaning device of claim 9, wherein the peaks are truncated and have an overall trapezoid shape when viewed in side elevation.

12. The cleaning device of claim 9, wherein the valleys are defined by adjacent sides of the truncated peaks, the valleys define an included angle of about 55°-90° between adjacent truncated peaks.

13. The cleaning device of claim 7, wherein said lower portion includes a plurality of positioning members.

14. The cleaning device of claim 7, wherein the upper portion includes an aperture defining a gripping rail providing a mechanism for manual manipulation of the handle.

15. The cleaning device of claim 7, wherein the cleaning member includes a sponge, brush, felt, fabric, abrasive material or a combination thereof.

16. The cleaning device of claim 7, wherein a plurality of cleaning heads can be coupled with the handle, the cleaning heads cleaning members may be manufactured from the same material or different material.

* * * * *